US007452053B2

(12) United States Patent
Valles et al.

(10) Patent No.: US 7,452,053 B2
(45) Date of Patent: Nov. 18, 2008

(54) FLUID AEROSOL EXTRACTION FOR SERVICE STATION OF FLUID EJECTION-DEVICE

(75) Inventors: Lluis Valles, Barcelona (ES); Joaquim Brugue, Barcelona (ES); Llorenc Valles, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 712 days.

(21) Appl. No.: 11/260,036

(22) Filed: Oct. 25, 2005

(65) Prior Publication Data

US 2006/0092217 A1 May 4, 2006

(30) Foreign Application Priority Data

Oct. 29, 2004 (EP) ..... 04105416

(51) Int. Cl.
*B41J 2/165* (2006.01)

(52) U.S. Cl. ..... 347/34

(58) Field of Classification Search ..... 347/22, 347/34, 83

See application file for complete search history.

(56) References Cited

U.S. PATENT DOCUMENTS 5,504,508 A 4/1996 Hashimoto
5,742,303 A 4/1998 Taylor et al.
6,746,099 B2 * 6/2004 Smith et al. ..... 347/34
7,357,479 B2 * 4/2008 Brugue et al. ..... 347/30
2003/0067505 A1 4/2003 Kumagai

FOREIGN PATENT DOCUMENTS

EP 0576033 A2 12/1993
EP 0788883 A2 8/1997
EP 1223042 A1 7/2002
EP 1403056 A1 3/2004

OTHER PUBLICATIONS

European search report in European counterpart patent application, 04105416.4-2304-, dated Apr. 1, 2005.

* cited by examiner

*Primary Examiner*—Shih-Wen Hsieh

(57) ABSTRACT

A fluid ejection device includes a fluid-ejection mechanism, a scanning carriage, and a service station. The fluid-ejection mechanism is capable of ejecting fluid onto media. The scanning carriage is that on which the fluid-ejection mechanism moves while ejecting fluid onto the media. The service station is that to which the fluid-ejection mechanism is movable by the scanning carriage, and that at which fluid aerosol from the fluid-ejection mechanism is extracted by a vacuum via an airflow path from the fluid-ejection mechanism temporarily fluidically coupled to the vacuum during servicing of the fluid-ejection mechanism.

22 Claims, 13 Drawing Sheets

FLUID AEROSOL EXTRACTION FOR SERVICE STATION OF FLUID EJECTION-DEVICE

RELATED PATENT APPLICATIONS

The present patent application claims priority under 35 USC 119 to the previously filed European patent application entitled "Method and apparatus for aerosol extraction in fluid-ejection devices," filed on Oct. 29, 2004, and assigned serial no. 04105416.4).

BACKGROUND OF THE INVENTION

Inkjet printers have become increasingly popular. A typical inkjet printer usually has a number of common components, regardless of its brand, speed, and so on. There is a print head that contains a series of nozzles used to eject drops of ink onto paper. Ink cartridges, either integrated into the print head or separate therefrom, supply the ink. There may be separate black and color cartridges, color and black in a single cartridge, a cartridge for each ink color, or a combination of different colored inks in a given cartridge. A print head motor typically moves the print head assembly back and forth horizontally, or laterally, across the paper, where a belt or cable is used to attach the assembly to the motor. Other types of printer technologies use either a drum that spins the paper around, or mechanisms that move the paper rather than the print head. The result is the same, in that the print head is effectively swept across the paper linearly to deposit ink on the paper.

A problem with at least some inkjet printers is the presence of aerosol. When a print head of the inkjet printer ejects the ink droplets from the nozzle, ideally they form a single drop that travels to the media. These small droplets stay suspended in air until they settle on a surface, creating a mist or aerosol of ink between the media and the print head and/or the carriage assembly. This aerosol can cause image-quality defects and print artifacts on the media, and may cause the printer to malfunction.

More specifically, the problems that are caused by aerosol can include the following. First, the media on which the ink is being ejected can be stained or marred by the aerosol, resulting in less than desirable image quality. Second, the aerosol can accumulate within the printer itself, which can then stain the user during operation. Third, accumulation of the aerosol within the printer can cause operational problems of the printer itself, especially where the aerosol builds up in slider rods and other movable parts of the printer. Fourth, accumulation of the aerosol within the printer can also build up on optical lenses and parts of the printer, such that they may fail. Fifth, aerosol accumulation can be detrimental cosmetically.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Representative Fluid-Ejection Device

Figure 1:
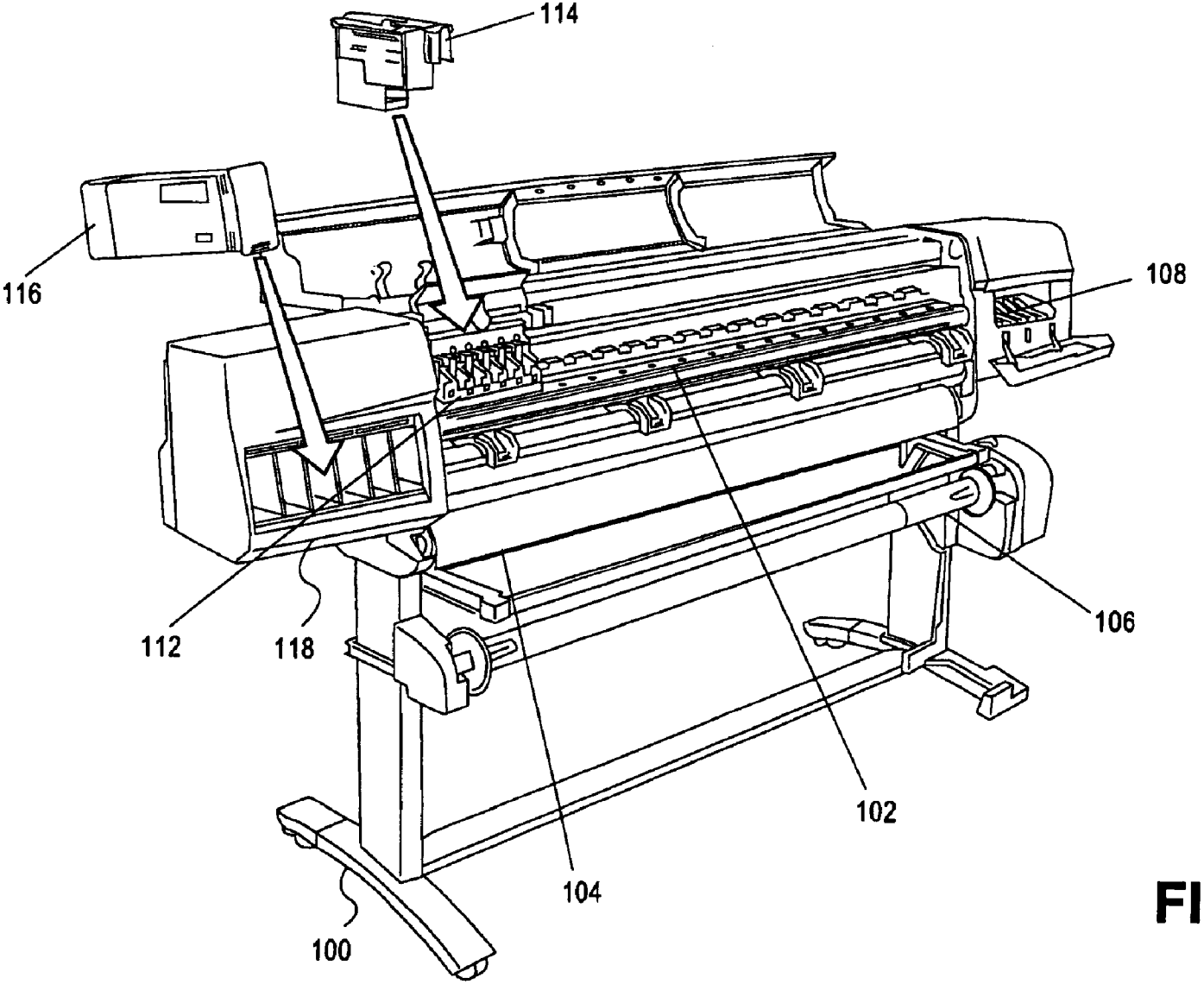
FIG. 1 is a diagram of a representative fluid-ejection device, according to an embodiment of the invention.

FIG. 1 shows a representative wide-format inkjet printer 100, according to an embodiment of the invention. The wide-format inkjet printer 100 is more generally an inkjet printer, and more generally still a fluid-ejection device. Other, smaller-format inkjet printers, such as those more typically found in home and office environments, may also be implemented in conjunction with embodiments of the invention. Furthermore, other types of fluid-ejection devices, include other types of inkjet-printing devices, may be implemented in conjunction with embodiments of the invention. The printer 100 includes a platen 102, a media roll 104, and a take-up roll 106 for the media. A servicing station 108 is situated on one side of the printer 100.

A carriage assembly 112 has inserted thereinto one or more print heads, such as the print head 114. The carriage assembly 112 may more generally be referred to as a fluid-ejection carriage, or a scanning carriage, on which print heads, such as the print head 114, move while ejecting ink onto media. The print heads themselves may more generally be referred to as an inkjet-printing mechanism or a fluid-ejection mechanism, which is capable of ejecting ink onto media. Finally, ink cartridges, such as the ink cartridge 116, are inserted into the ink station 118. The print heads are fed from ink cartridges 116 with ink from an ink supply not depicted in FIG. 1. In other types of inkjet printers, the ink cartridges may be inserted into the carriage assembly 112 itself, in corresponding print heads. Furthermore, the ink cartridges may be integrated into the print heads themselves in such printers. The assembly 112 further scans across media in a direction perpendicular to movement of the media. In the embodiment of FIG. 1, the assembly 112 scans across the media horizontally, where the media is itself advanced vertically. While scanning across the media, the assembly 112 ejects ink. Ink ejection may be accomplished thermally, piezoelectrically, or in another manner.

The carriage assembly 112 is able to transport the print heads, such as the print head 114, to the servicing station 108 for servicing. In the context of embodiments of the invention, such servicing includes an operation referred to as spitting, which causes one or more nozzles of the print head 114 to eject drops of fluid in sequence, usually at high frequency. Spitting clears the print heads, or other fluid-ejection mechanisms being employed, so that proper inkjet printing can occur when image formation is desired on media. During the spitting process, significant aerosol may occur. The servicing station 108 includes spittoons (shown in FIGS. 6 and 7, as described later in the detailed description), into which the print heads, or other fluid-ejection mechanisms being employed, spit ink during the spitting process, or other servicing operations.

Aerosol Extraction During Printing and During Servicing

Figure 2:
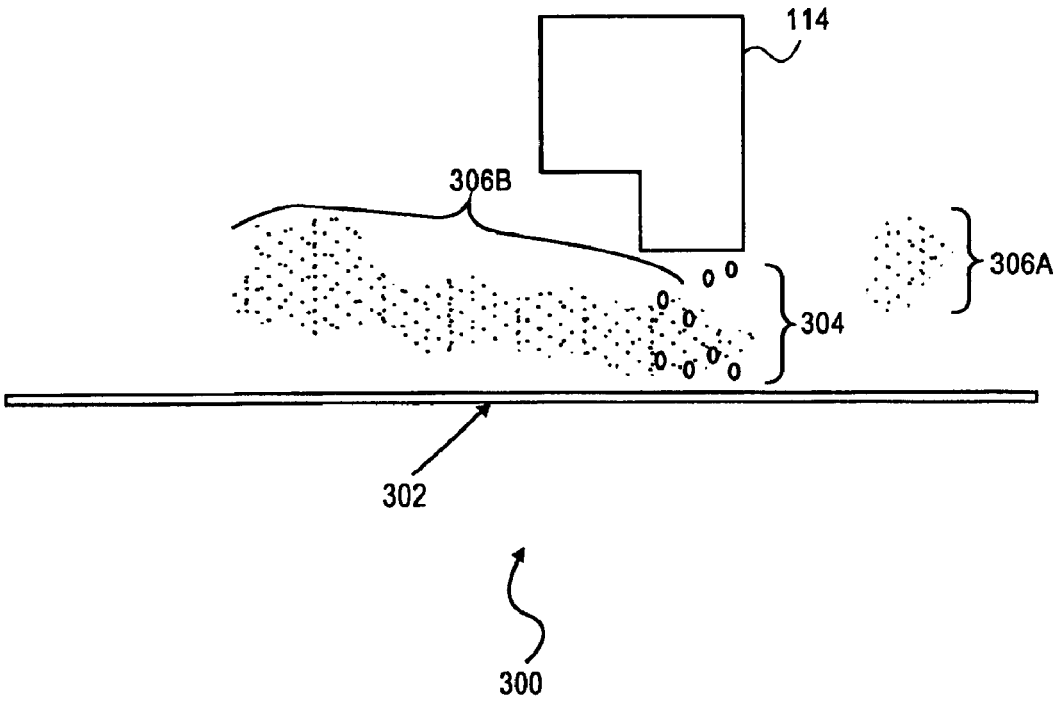
FIG. 2 is a diagram depicting the generation of aerosol during printing, according to an embodiment of the invention.

FIG. 2 shows a scenario 300 of the generation of undesirable aerosol during printing by the printer 100, according to an embodiment of the invention. For illustrative clarity, just the print head 114 of the printer 100 is depicted in FIG. 2. The print head 114 moves over the media 302, which may be paper, into and out of the plane of FIG. 2 to eject ink drops 304 onto the media 302. The media 302 itself is movable from left to right, such that the print head 114 moves perpendicular to movement of the media 302. During ejection of the ink drops 304, aerosol 306A and 306B can result. The aerosol 306A and 306B, collectively referred to as the aerosol 306, can cause the problems delineated in the background section.

Figure 3:
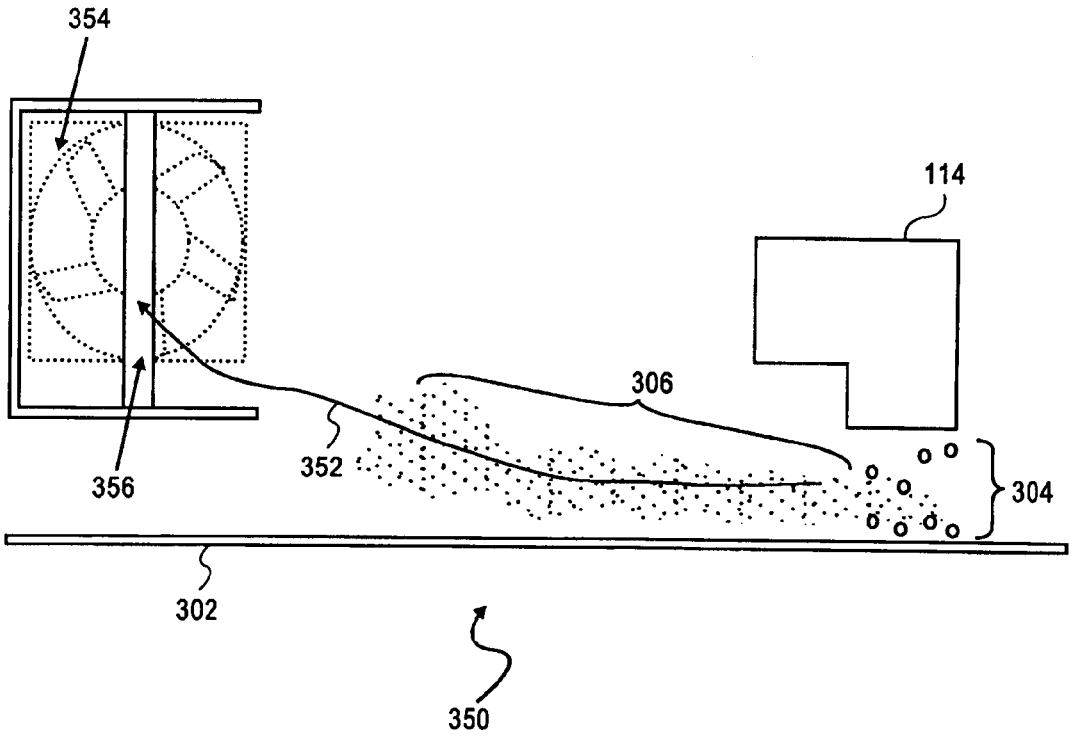
FIG. 3 is a diagram depicting the generation and also the extraction of aerosol during printing, according to an embodiment of the invention.

FIG. 3 shows a scenario 350 of the generation and also the extraction of aerosol during printing by the printer 100, according to an embodiment of the invention. For illustrative clarity, just the print head 114, a fan 354, and a filter 356 of the printer 100 are depicted in FIG. 3. As in FIG. 2, the print head 114 moves over the media 302 in FIG. 3, into and out of the plane of FIG. 3 to eject ink drops 304 onto the media 302, which itself is movable from left to right. The aerosol 306 that results from ejection of the ink drops 304 is substantially extracted before it comes to rest on the components or subsystem of the printer 100, or the media 302. Extraction of the aerosol 306 generally occurs by the use of a fan 354. The fan 354 creates an air current which causes the aerosol 306 to be sucked into the filter 356, such that the aerosol 306 becomes lodged in the filter 356, as indicated by the arrow 352.

Figure 4A:
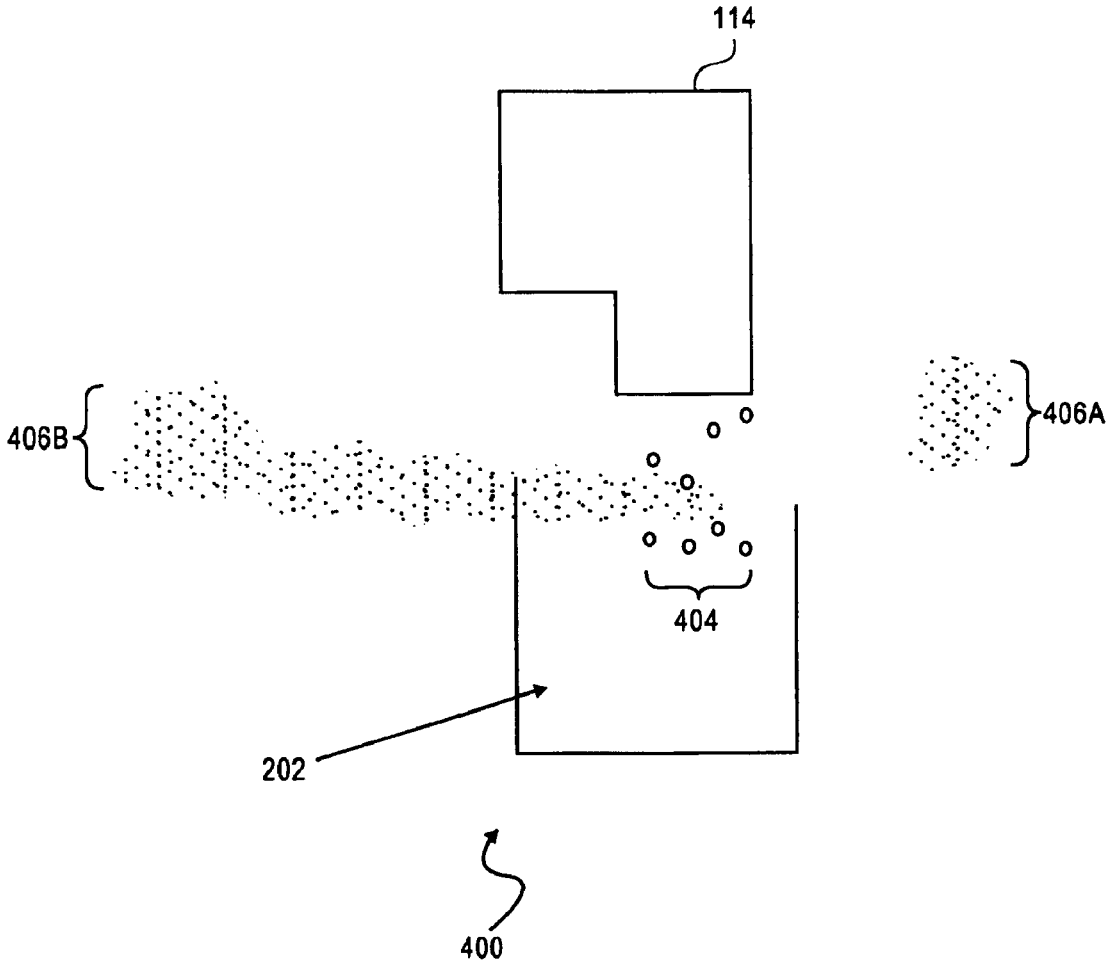
FIG. 4A is a diagram depicting the generation of aerosol during print head servicing, according to an embodiment of the invention.

FIG. 4A shows a scenario 400 of the generation of aerosol during servicing of the print head 114 of the printer 100 at the spittoon 202 of the servicing station 108, according to an embodiment of the invention. For illustrative clarity, just the print head 114 and the spittoon 202 are depicted in FIG. 4A. The print head 114 moves to a position over the spittoon 202, and then begins spitting, or ejecting ink or other fluid, at high frequency for a duration of time to clear the ink-ejection nozzles of the print head 114. Most of the ejected ink results in ink drops 404, which are ejected into the spittoon 202 for occasional emptying. However, some of the ink is ejected by the print head 114 in the form of aerosol 406A and 406B, collectively referred to as the aerosol 406. As with the aerosol 306 of FIG. 2 that occurs during printing, the aerosol 406 of FIG. 4A can cause the problems outlined in the background section.

Figure 4B:
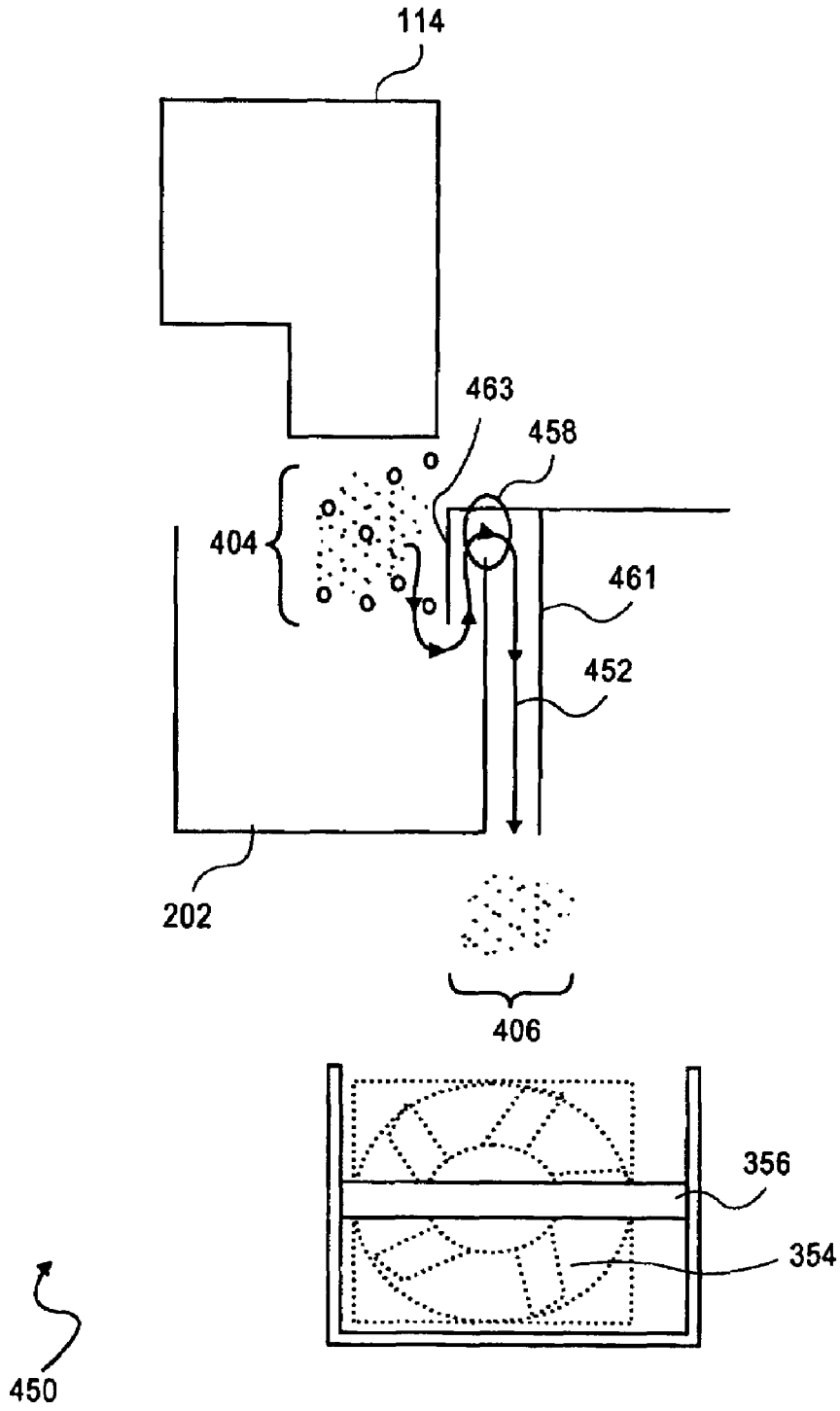
FIG. 4B is a diagram depicting the generation and also the extraction of aerosol during print head servicing, according to an embodiment of the invention.

FIG. 4B shows a scenario 450 of the generation and also the extraction of aerosol during servicing of the print head 114 of the printer 100 at the spittoon 202 of the servicing station 108, according to an embodiment of the invention. For illustrative clarity, just the print head 114, the spittoon 202, the fan 354, and the filter 356 of the printer 100 is depicted in FIG. 4B. As in FIG. 4A, the print head 114 is positioned over the spittoon 202, and begins the spitting operation to clear ink-ejection nozzles of the print head 114. Although most of the ink ejected by the print head 114 is in the form of ink droplets 404 that are fired into the spittoon 202, some of the ink is ejected in the form of aerosol 406, which in the scenario 450 is substantially extracted before it can come into contact with other parts and components of the printer. Extraction of the aerosol 406 generally occurs by the use of a fan 354. The fan 354 creates an air current which causes the aerosol 406 to be sucked into the filter 356, such that the aerosol 406 becomes lodged in the filter 356, as indicated by the arrow 452.

It is noted that the vacuum passage, or duct, 461 into which the aerosol 406 is sucked, as indicated by the arrow 452, is such that there is a hood, or cowling, 463 extending into the spittoon 202. The hood 463 serves the following purpose. The air current resulting from the fan 354 is an upward air current between the hood 463 and the right sidewall of the spittoon 202 (the right sidewall having the oval 458 immediately above it) due to the hood 463, into the vacuum passage 461 at which point the air current is downward. Without the hood 463, the air current would be a sideways air current across the opening of the spittoon 202 into the opening of the spittoon 202 indicated by the oval 458, perpendicular to the movement of ejection of the droplets 404, and possibly affecting their trajectory towards the bottom of the spittoon 202 thereafter, the air current as before is downward within the vacuum passage 461). Therefore, the hood 463 is beneficial in that it redirects the air current so that it does not affect the trajectory of the droplets 404 as much towards the bottom of the spittoon 202.

Furthermore, there are generally two types of aerosol that are created: heavier, pigment-based aerosol, and lighter, dye-based aerosol. Aerosol-related problems typically result from the lighter aerosol, not the heavier aerosol. This is because the heavier aerosol will, due to gravity, accumulate or settle on the bottom of the spittoon 202 (as opposed to the firing or ejection of the droplets 404 themselves towards the bottom of the spittoon 202). The lighter aerosol, by comparison, tends to linger, and may float away and out of the spittoon before it rests on other parts of the printer, or on the media itself, causing the problems indicated in the background section. Therefore, the air current created by the fan 354, through the passage 461, sucks this lighter aerosol into the filter 356, so that this aerosol does not cause these problems, or substantially reduces these problems.

Aerosol Extraction System

Figure 5:
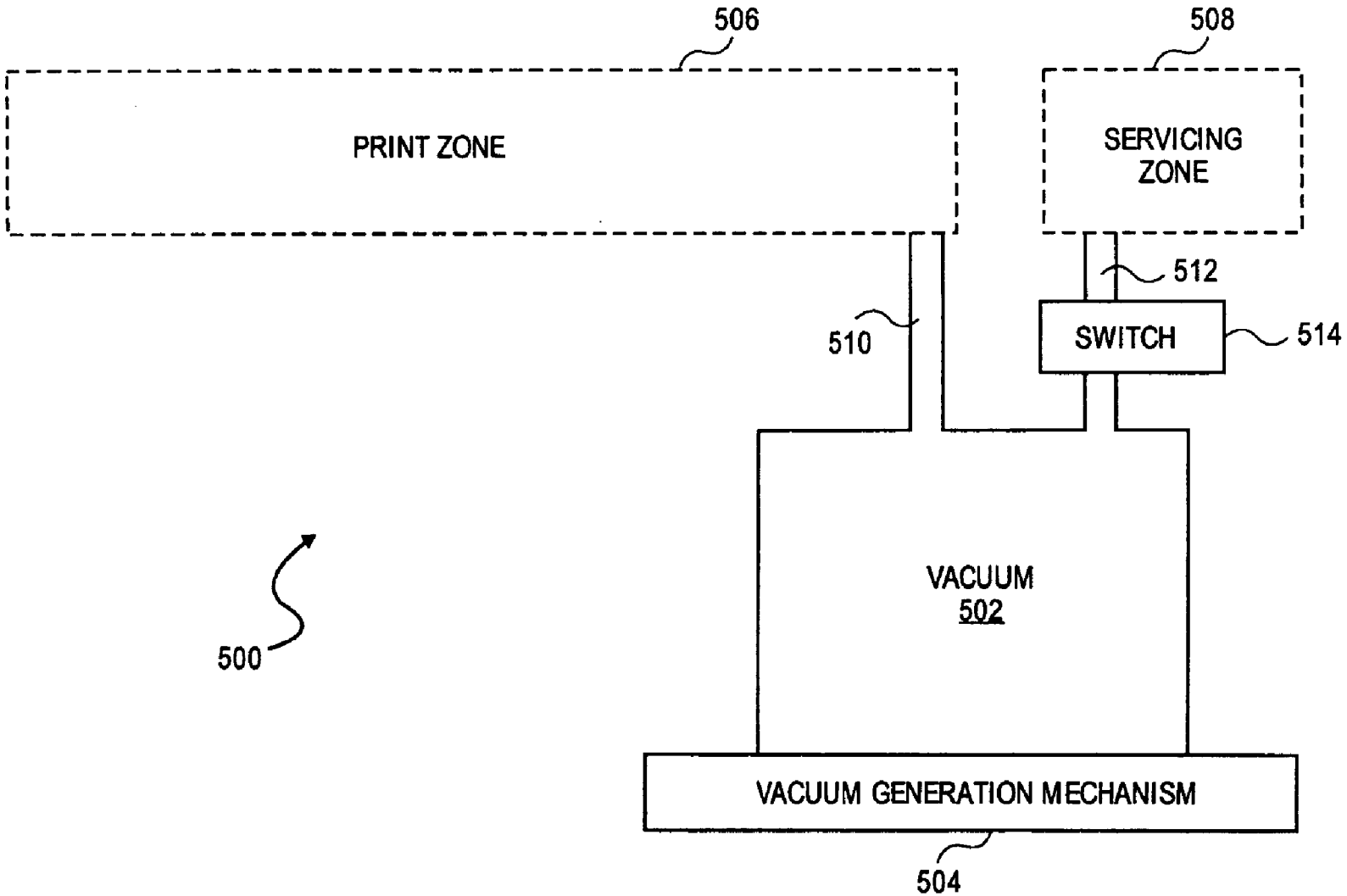
FIG. 5 is a block diagram of an aerosol extraction system that employs a single vacuum for both the print zone, in which printing occurs, and the servicing zone, in which print head servicing occurs, of a printer, according to an embodiment of the invention.

FIG. 5 shows a block diagram of an aerosol extraction system 500, according to an embodiment of the invention. The aerosol extraction system 500 allows for a single vacuum 502 to be employed in both the print zone 506 and the servicing zone 508. The print zone 506 is the location of the printer 100 in which printing occurs, generation of aerosol during which has been described in relation to FIGS. 2 and 3. The servicing zone 508 is the location of the printer 100 in which servicing of the print head 114 occurs, generation of aerosol during which has been described in relation to FIGS. 4A and 4B. The vacuum 502 occurs due to a vacuum generation mechanism 504. For instance, in one embodiment of the invention, the vacuum generation mechanism 504 includes the fan 354 that has been described, to generate the vacuum 502.

The vacuum 502 is interfaced to the print zone 506 via at least a single conduit, pipe, or tube 510, whereas the vacuum 502 is interfaced to the servicing zone 508 via at least a single conduit, pipe, or tube 512. As depicted in FIG. 5, the vacuum 502 permanently interfaces with, or engages, the print zone 506. That is, the tube 510 connects the vacuum 502 to the print zone 506 at all times. By comparison, the vacuum 502 switchably interfaces with, or engages, the servicing zone 508, via a switching mechanism 514. That is, the tube 512 connects the vacuum 502 to the servicing zone 508 only when the switching mechanism 514 so allows, and otherwise the vacuum 502 is cut off from the servicing zone 508, via interruption of the tube 512. The manner by which the switching mechanism 514 can be implemented and operates in one embodiment of the invention is described in detail in subsequent sections of the detailed description.

The presence of the switching mechanism 514 advantageously allows for the full force of the vacuum 502 to be employed in the print zone 506 when the printer 100 is being used for printing, and the print head 114 is not being serviced. When the print head 114 of the printer 100 requires servicing, the switching mechanism 514 then opens the vacuum 502 to the servicing zone 508, so that aerosol may be extracted during servicing of the print head 114. In one embodiment, the switching mechanism 514 is an automatic switching mechanism that does not require user interaction. That is, a user does not have to actuate or otherwise operate the switching mechanism 514 so that the vacuum 502 is activated for aerosol extraction during servicing of the print head 114 in the servicing zone 508. Rather, movement of a servicing carriage can automatically cause the switching mechanism 514 to expose the vacuum 502 to the servicing zone 508 for aerosol extraction, in one embodiment of the invention.

The vacuum 502 thus has two states. In one state, the switching mechanism 514 operably connected the servicing zone 508 to the vacuum 502. As a result, in this state both the servicing zone 508 and the print zone 506 are operably connected to the vacuum 502, since the print zone 506 remains operably connected to the vacuum 502 at all times. In another state, the switching mechanism operably disconnects the servicing zone 508 from the vacuum 502. As a result, in this state only the print zone 506 is operably connected to the vacuum 502.

The switching mechanism 514 has been described as being automatically actuated by a servicing carriage, to cause fluidic coupling of the servicing zone 508 to the vacuum 502, where the print zone 506 is always fluidically coupled to the print zone 506. This embodiment of the invention is described in more detail in the following sections of the detailed description. However, in other embodiments of the invention, the switching mechanism 514 can be automatically actuated in ways other than by the servicing carriage. Furthermore, the switching mechanism 514 may be manually actuated by the user. In addition, the switching mechanism 514 may fluidically couple either or both of the print zone 506 and the servicing zone 508 to the vacuum 502 in a variety of configurations. For example, when the print zone 506 is fluidically coupled to the vacuum 502, the servicing zone 508 may not be, and vice-versa. Alternatively, the zones 506 and 508 may be fluidically coupled to the vacuum 502 in unison, such that both zones are fluidically coupled to the vacuum 502, or none of them are. Alternatively still, fluidic coupling of the zones 506 and 508 to the vacuum 502 may be independent of one another. For instance, fluidic coupling of the zone 506 may be able to be switched on and off independent of fluidic coupling of the zone 508, and similarly fluidic coupling of the zone 508 may be able to be switched on and off independent of the fluidic coupling of the zone 506.

Aerosol Extraction Components within the Servicing Station

Figure 7:
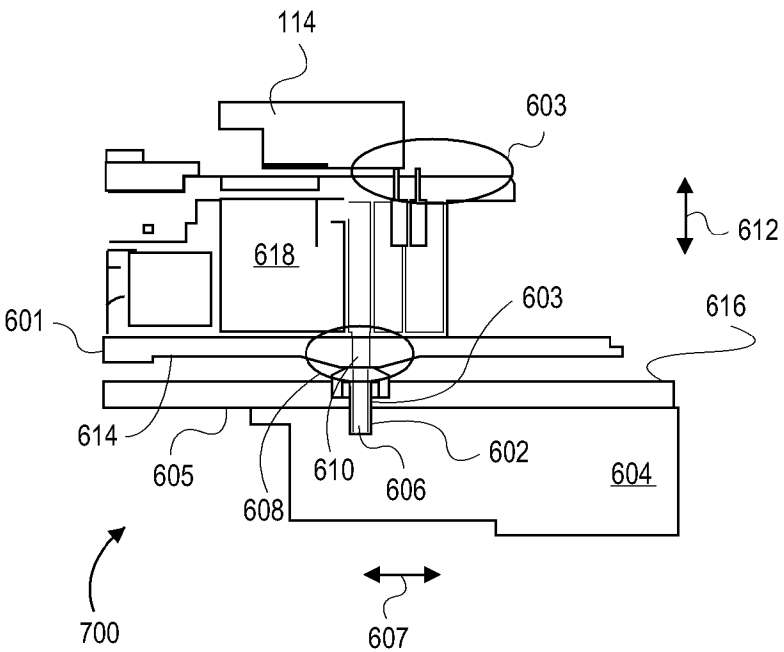
FIG. 7 is a diagram of a side profile of aerosol extraction components of a servicing station of a printer, specifically with respect to a second position of a movable, or servicing, carriage in relation to a stationary chassis, according to an embodiment of the invention.
Figure 6:
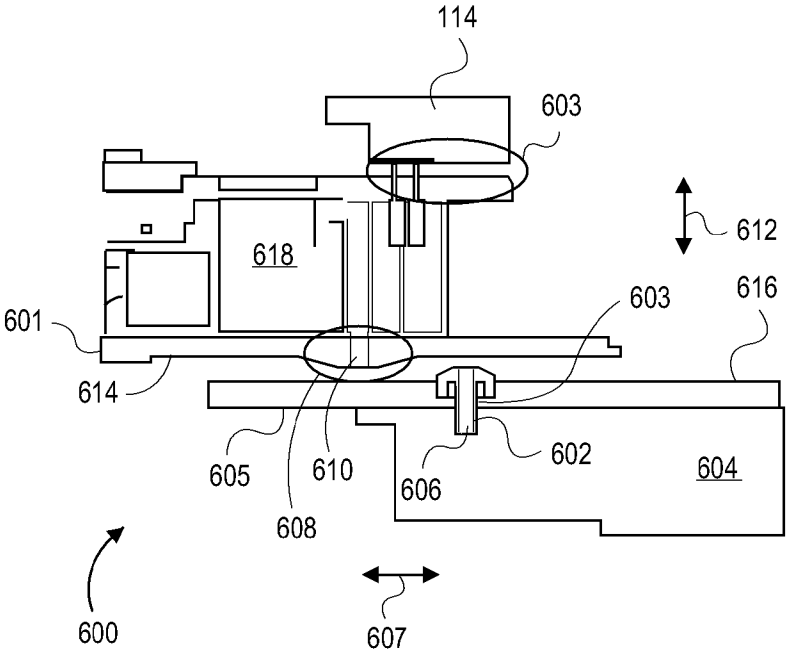
FIG. 6 is a diagram of a side profile of aerosol extraction components of a servicing station of a printer, specifically with respect to a first position of a movable, or servicing, carriage in relation to a stationary chassis, according to an embodiment of the invention.

FIGS. 6 and 7 show first and second positions 600 and 700 of aerosol extraction components within the servicing station 108 of the printer 100, according to an embodiment of the invention. A servicing carriage 601 is able to move left and right over a stationary chassis 605, as indicated by the bi-directional arrow 607. When an ink-ejection scanning carriage is brought into the servicing station 108, on an axis perpendicular to the plane of FIGS. 6 and 7, the servicing carriage 601 is in the first position 600 as depicted in FIG. 6. In this position 600, print heads 114 are aligned with the wipers 603 mounted on carriage 601. The servicing carriage 601 has a bottom surface 614, from which a protruding portion 608 extends. The protruding portion 608 may also be referred to as a ramped element, or as a cam. A hole 610 is defined at the end of the protruding portion 608 of the bottom surface 614 of the carriage 601. The hole 610 defines an airflow path through the protruding portion 608, and thus from the spittoon 618.

The stationary chassis 605 includes a vacuum 604, which in one embodiment is the vacuum 502 of FIG. 5. The stationary chassis 605 has a top surface 616 within which a retractable element 602, or retractable member, is slidably and sealably inserted into a hole 603 thereof. The retractable element 602 is slidably inserted into the hole of the top surface 616 in that it is able to move up and down, as indicated by the bi-directional arrow 612. The retractable element 602 is sealably inserted into the hole of the top surface 616 in that there is substantially no leakage around the element 602 to the vacuum 604. Rather, the retractable element 602 includes a hole 606 therethrough that is the only manner by which the vacuum 604 is accessible in one embodiment of the invention.

The hole 606 defines an airflow path through the retractable element 602, and thus to the vacuum 604 of the chassis 605.

In FIG. 6, the servicing carriage 601 is aligned in a first position 600 with respect to the stationary chassis 605. Movement of the carriage 601 from left to right causes the print heads 114 to be subjected to a wiping action by the wipers 603. That is, the carriage 601 is moved relative to the print heads 114 perform an initial cleaning, or servicing, of the print heads 114, via the wipers 603. Furthermore, movement of the servicing carriage 601 from left to right, as indicated by the bi-directional arrow 607 causes the protruding portion 608 of the bottom surface 614 of the carriage 601 to come into contact with the retractable element 602 inserted within the hole of the top surface 616 of the stationary chassis 605. The protruding portion 608 of the carriage 601 pushes the retractable element 602 down, as indicated by the bi-directional arrow 612, and the servicing carriage 601 continues moving left to right until the hole 610 of the protruding portion 608 is at least substantially aligned with the hole 606 of the retractable element 602, as depicted in FIG. 7. The retractable element 602 thus has two positions: a first position in which the element 602 is fully extended over the surface 616, as depicted in FIG. 6, and a second position in which it has been pushed downwards towards the surface 616 by the protruding portion 608, as depicted in FIG. 7.

When the servicing carriage 601 is in the second position 700 of FIG. 7, the print heads are aligned with the spittoon 618, enabling or allowing the spitting process to be performed, collection of the ink droplets occurring in the spittoon 618, and collection of the aerosol sucked into the vacuum 604. That is, in FIG. 7, when the hole 610 of the protruding portion 608 of the servicing carriage 608 is at least substantially aligned with the hole 606 of the retractable element 602 inserted within the stationary chassis 605, the vacuum 604 is able to fluidically couple with the spittoon 618. It can be said that a fluidic channel has opened between the vacuum 604 and the spittoon 618. Therefore, during a spitting service process, aerosol that is ejected from the print heads 114 and is not collected within the spittoons 618 is instead transferred from the servicing carriage 601 to the vacuum 604 of the stationary chassis 605. Transfer of such aerosol is possible because the airflow path defined by the hole 610 of the protruding portion 608 interacts with the airflow path defined by the hole 606 of the retractable element 602. Spitting of the print heads 114 is thus accomplished when the servicing carriage 601 has moved from the position 600 in FIG. 6 to the position 700 in FIG. 7.

Once the spitting process has finished, the servicing carriage 601 moves from where it is depicted in FIG. 7 back to where it is depicted in FIG. 6, from where the print heads 104 can be moved on a scanning carriage to resume printing. As the servicing carriage 601 moves from right to left, as indicated by the bi-directional arrow 607, the protruding portion 608 no longer contacts and pushes the retractable element 602 downward. As a result, the retractable element reverts from its second position, as depicted in FIG. 7, back to its first position, as depicted in FIG. 6. Furthermore, the joined airflow path between the airflow path of the protruding portion 608, as defined by the hole 610 thereof, and the airflow path of the retractable element 602, as defined by the hole 606 thereof, is broken, such that the spittoon 618 is no longer fluidically connected to the vacuum 604.

Figure 8:
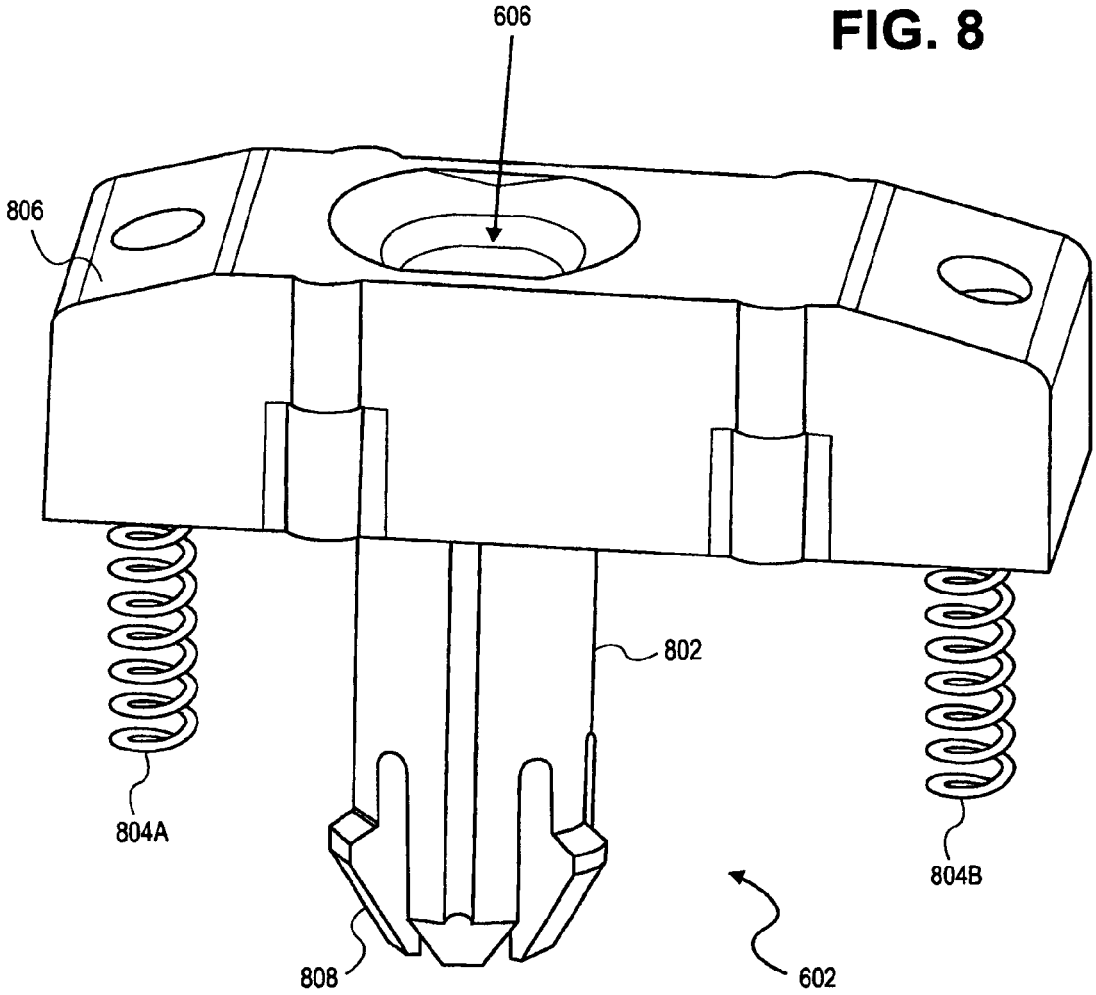
FIG. 8 is a diagram of a retractable element or member that is insertable into a hole within a surface of the stationary chassis of the aerosol extraction system of FIGS. 6 and 7 in detail, according to an embodiment of the invention.

FIG. 8 shows the retractable element 602 in detail, according to an embodiment of the invention. The retractable element 602 includes a tube 802, or tubular body, through which the hole 606 runs. An upper portion 806 of the retractable element 602 is that which the protruding portion 608 of the servicing carriage 601 contacts and pushes against in moving it from its position in FIG. 6 to its position in FIG. 7. A lower portion 808 of the retractable element 602 is that which is situated within the vacuum 604 of the stationary chassis 605 in FIGS. 6 and 7. Springs 804A and 804B, collectively referred to as the springs 804 and which are more generally spring elements, cooperate with and enable the retractable element 602 to move from its second position, as depicted in FIG. 7, back to its first position, as depicted in FIG. 6, when the protruding portion 608 of the carriage 601 no longer pushes against the retractable element 602. In other words, the springs 804 allow the retractable element to revert back to and remain at its first position depicted in FIG. 6. Besides springs, foam or another type of spring element may be employed.

Figure 9:
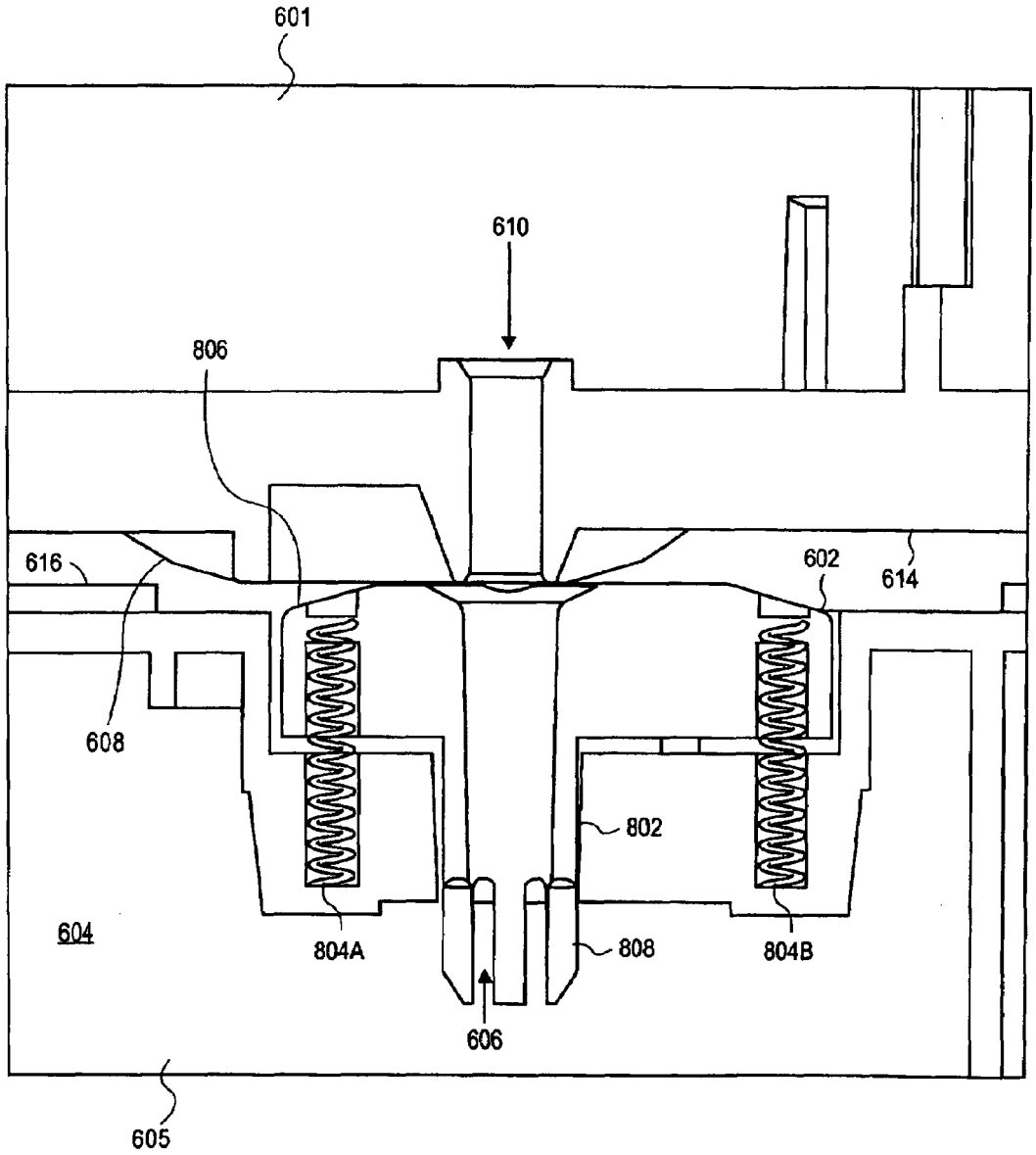
FIG. 9 is a diagram of the side profile of FIG. 7 in detail, specifically showing the retractable element or member cooperating with a protruding portion or ramped element of a bottom surface of the servicing carriage, according to an embodiment of the invention.

FIG. 9 shows the retractable element 602 of FIG. 8 where its upper portion 806 has been pushed downwards by the protruding portion 608 of the servicing carriage 601, as in FIG. 7, but in more detail, according to an embodiment of the invention. The protruding portion 608 extends downward from the bottom surface 614 of the servicing carriage 601, and includes the hole 610 therethrough defining an airflow path. The retractable element 602 is inserted within an opening in the top surface 616 of the stationary chassis 605. The protruding portion 608 has contacted the upper portion 806, pushing the retractable element 602 downward. The hole 610 of the protruding portion 608 is at least substantially aligned with the hole 606 of the tube 802 of the retractable element 602. As such, the airflow path defined by the hole 610 and the airflow path defined by the hole 606 are joined, and the vacuum 604 is fluidically connected or coupled to the servicing carriage 601 through the holes 610 and 606, and out of the lower portion 808 of the retractable element 602. When the protruding portion 608 no longer contacts the upper portion 806 of the retractable element 602, the springs 804 cause the retractable element 602 to revert to its first position extending past the surface 616 of the chassis 605.

Retractable Member or Element as Switching Mechanism

The embodiments of the invention of the previous section of the detailed description have been described as employing the retractable element, or member, 602 in which the hole 606 extends vertically through the body of the retractable element 602. The hole 606 allows the corresponding hole 610 within the protruding portion 608 of the servicing carriage 601 to mate therewith, so that the servicing carriage 601 makes a fluidic connection to the vacuum 604, as depicted in FIG. 7. However, when the servicing carriage 601 is not positioned to the right side of the stationary chassis 605, such that the hole 610 within the protruding portion 608 does not mate with the hole 606, the vacuum 604 is not sealed, since the hole 606 extends from the vacuum 604 to outside of the vacuum 604, as depicted in FIG. 6.

This means that the vacuum 604 may not be able to be used for other purposes even when servicing of the fluid-ejection mechanism is not currently being performed. For instance, the vacuum 604 may not be usable for other operations in which aerosol is desired to be transferred into the vacuum 604, such as during image formation by the fluid-ejection mechanism on media, because the vacuum 604 is not sealed due to the hole 606 extending from inside the vacuum 604 to outside. Therefore, in an exemplary embodiment of the invention, the servicing carriage 601, when in the position 600 of FIG. 6, blocks the hole 606 of the retractable element 602, so that the hole 606 is blocked, such that the vacuum 604 is at least substantially sealed.

In this embodiment, the retractable element 602 serves as or as a part of the switching mechanism 514 of FIG. 5 that has been described. The retractable element 602 in this embodiment causes the vacuum 502 or 604 to be interfaced with the servicing zone 508 when servicing, specifically spitting, of the print head 114 is to occur, and otherwise seals the vacuum 502 or 604 with respect to the servicing zone 508. In such an embodiment, the vacuum 604 of FIGS. 6 and 7 may be the vacuum 502, in that the vacuum 604 may be connected to the print zone 506 as described in relation to FIG. 5. Furthermore, in one such embodiment, there is no specific tube 512 as depicted in FIG. 5, since the retractable element 602 acts as both the switching mechanism 514 and the manner by which the vacuum 502 interfaces with the servicing zone 508.

Figure 10:
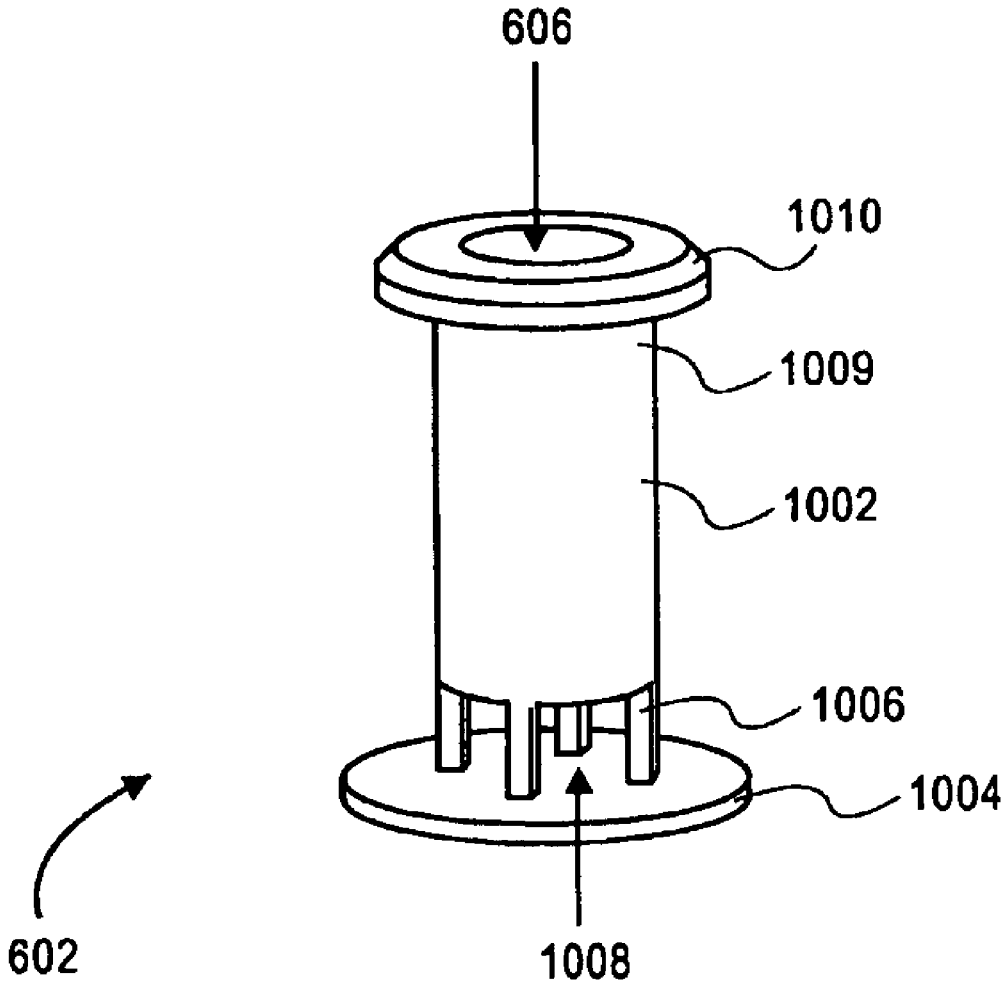
FIG. 10 is a diagram of a retractable element or member, according to another embodiment of the invention, which allows a vacuum of the stationary chassis to be used for other purposes when the fluid-ejection mechanism is not being serviced.

FIG. 10 shows the retractable element, or member, 602, according to another embodiment of the invention, which also allows the vacuum 604 to be used for other operations when fluid-ejection mechanism servicing is not occurring, by sealing the vacuum 604 when such servicing is not currently being performed. The retractable element 602 of FIG. 10 includes a tube 1002, a base 1004, and a rim 1010. The base 1004 is situated at a back end 1006 of the tube 1002, at which the tube 1002 has access holes 1008 around a perimeter thereof where the tube 1002 meets the base 1004. The rim 1010 is situated at a front end 1009 of the tube 1002, and has the hole 606 running therethrough.

Figure 11:
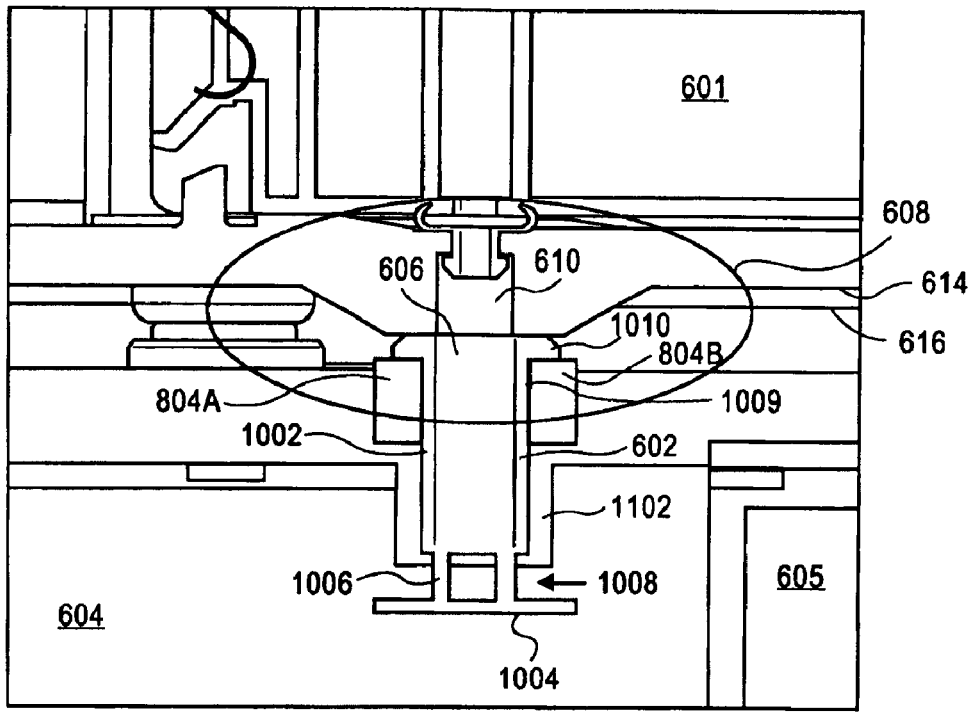
FIG. 11 is a diagram of a side profile of aerosol extraction components of a servicing station of a printer in which the retractable element of FIG. 10 is being used, specifically with respect to a first position of a movable, or servicing, carriage in relation to a stationary chassis, according to an embodiment of the invention.

FIG. 11 shows a side profile of how the retractable element 602 of FIG. 10 interfaces with the protruding portion 608 of the servicing carriage 601 in the second position of the retractable element 602, where the protruding portion 608 has contacted and pushed down the rim 1010 of the retractable element 602, according to an embodiment of the invention. The tube 1002 of the retractable element 602 is slidably inserted into a hole of a correspondingly larger tube 1102 of the stationary chassis 605. The hole 606 of the tube 1002 defines the airflow path of the retractable element 602 to the vacuum 604. The protruding portion 608 extends from the bottom surface 614 of the servicing carriage 601, and has contacted and pushed the rim 1010 of the retractable element 602 against the top surface 616 of the stationary chassis 605. The force from the protruding portion 608 against the rim 1010 of the retractable element 602 pushes down the springs 804.

As a result, the base 1004 of the retractable element 602 is pushed into the vacuum 604, and does not contact the tube 1102. The access holes 1008 are therefore open to the vacuum 604, and a joined airflow path from the servicing carriage 601, through the hole 610 of the protruding portion 608 of the carriage 601, to the hole 606 of the retractable element 602 and into the vacuum 604, results. The second position of the retractable element 602 in the embodiment of FIG. 10 corresponds to the second position of the retractable element 602 that was previously depicted in and described in relation to FIG. 7 in the previous section of the detailed description. In the second position of the retractable element 602 in the embodiment of FIG. 10, the airflow path of the retractable element 602 is unblocked, and is open to the vacuum 604.

Figure 12:
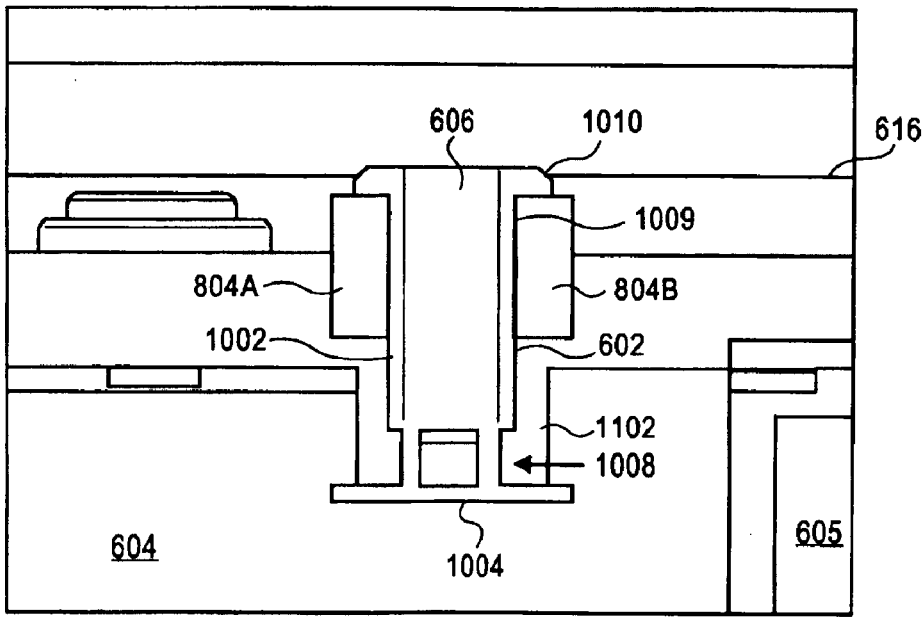
FIG. 12 is a diagram of a side profile of aerosol extraction components of a servicing station of a printer in which the retractable element of FIG. 10 is being used, specifically with respect to a second position of a movable, or servicing, carriage in relation to a stationary chassis, according to an embodiment of the invention.

FIG. 12 shows a side profile of how the retractable element 602 has its airflow path blocked when in the first position thereof, according to an embodiment of the invention. The servicing carriage 601 has moved away, such that the protruding portion 608 is no longer in contact with the rim 1010 of the retractable element 602. As such, the springs 804 force the retractable element 602 upward, back to its first position. Although the hole 606 through the tube 1002 of the retractable element 602 is still open at the rim 1010, the base 1004 of the retractable element 602 has sealed the hole 606 and the access holes 1008 from the vacuum 604. That is, the base 1004 has moved upwards, and is now situated against the tube 1102 of the stationary chassis 605. The movement of the base 1004 in this manner blocks the access holes 1008 via the tube 1102, and thus access of the hole 606 to the vacuum 604.

The air path of the retractable element 602 is therefore blocked relative to the vacuum 604 in the first position of the retractable element 602, due to the access holes 1008 being blocked. As a result, the vacuum 604 can be used for other purposes, such as for aerosol extraction of the print zone, as has been described. However, when the vacuum 604 is in fact needed for removal or transfer of aerosol from the servicing carriage 601, the contacting and pushing against of the protruding portion 608 thereof relative to the retractable element 602 causes the access holes 1008 to become unblocked, and the air path of the retractable element 602 to become unblocked, as has been described in relation to FIG. 11.

Methods

Figure 13:
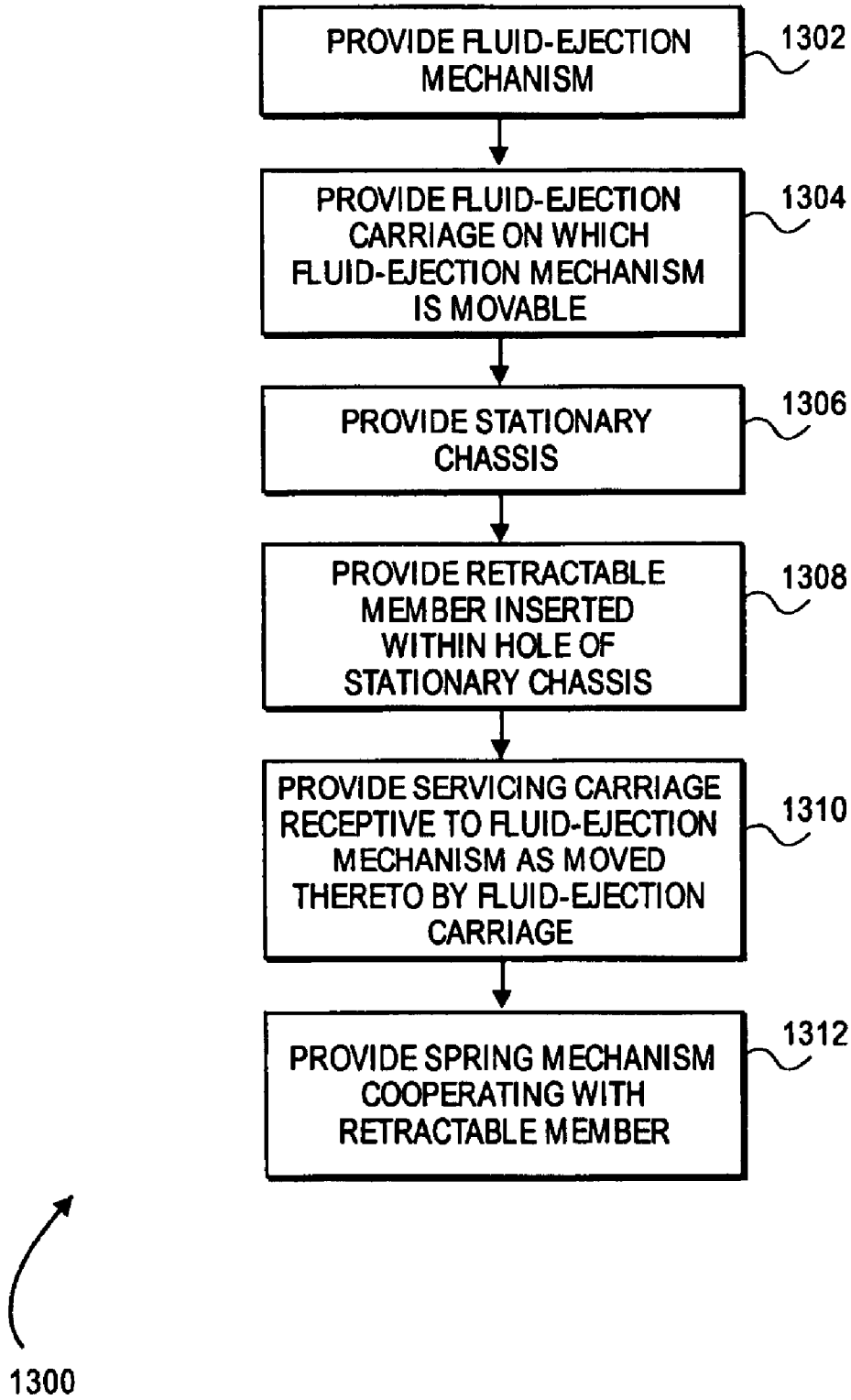
FIG. 13 is a flowchart of a method of manufacture of a fluid-ejection device, according to an embodiment of the invention.

FIG. 13 shows a method 1300 of manufacture of a fluid-ejection device, according to an embodiment of the invention. The fluid-ejection device resulting from the method 1300 may be the inkjet printer 100 of FIG. 1 that has been described. First, a fluid-ejection mechanism is provided that is capable of ejecting fluid onto media (1302). The fluid-ejection mechanism may be or include the inkjet print heads 114 of FIG. 5 that have been described. Next, a fluid-ejection carriage on which the fluid-ejection mechanism is movable while ejecting fluid onto the media to form an image on the media is provided (1304). The fluid-ejection carriage may be the carriage assembly 112 of FIG. 1 that has been described.

A stationary chassis is provided (1306), in which there is a hole through a surface thereof leading to a vacuum. The stationary chassis may be the stationary chassis 605 that has been described. A retractable member is also provided that is inserted within the hole of the stationary chassis (1308). The retractable member is more specifically slidably and sealably inserted within this hole, and defines an airflow path to the vacuum of the stationary chassis. The retractable member may be the retractable element 602 of FIG. 6 or of FIG. 10 that has been described. The retractable member has a first position in which it is extended from a surface of the stationary chassis, as in FIGS. 6 and 12, and a second position in which it is pushed downwards towards this surface, as in FIGS. 7 and 11.

Next, a servicing carriage is provided that is receptive to the fluid-ejection mechanism as moved thereto by the fluid-ejection carriage (1310). The servicing carriage may be the servicing carriage 601 that has been described. The servicing carriage has a bottom surface from which a protruding, or extended, portion thereof ends in a hole defining an airflow path from the fluid-ejection mechanism. The protruding portion is thus contactable with the retractable member to push the retractable member from its first position to its second position. Finally, a spring mechanism may be provided that cooperates with the retractable member (1312). The spring mechanism may be the springs 804 of FIG. 8. The spring mechanism causes the retractable member to revert to and remain in its first position when the extrude portion no longer contacts and pushes the retractable member to its second position.

Figure 14:
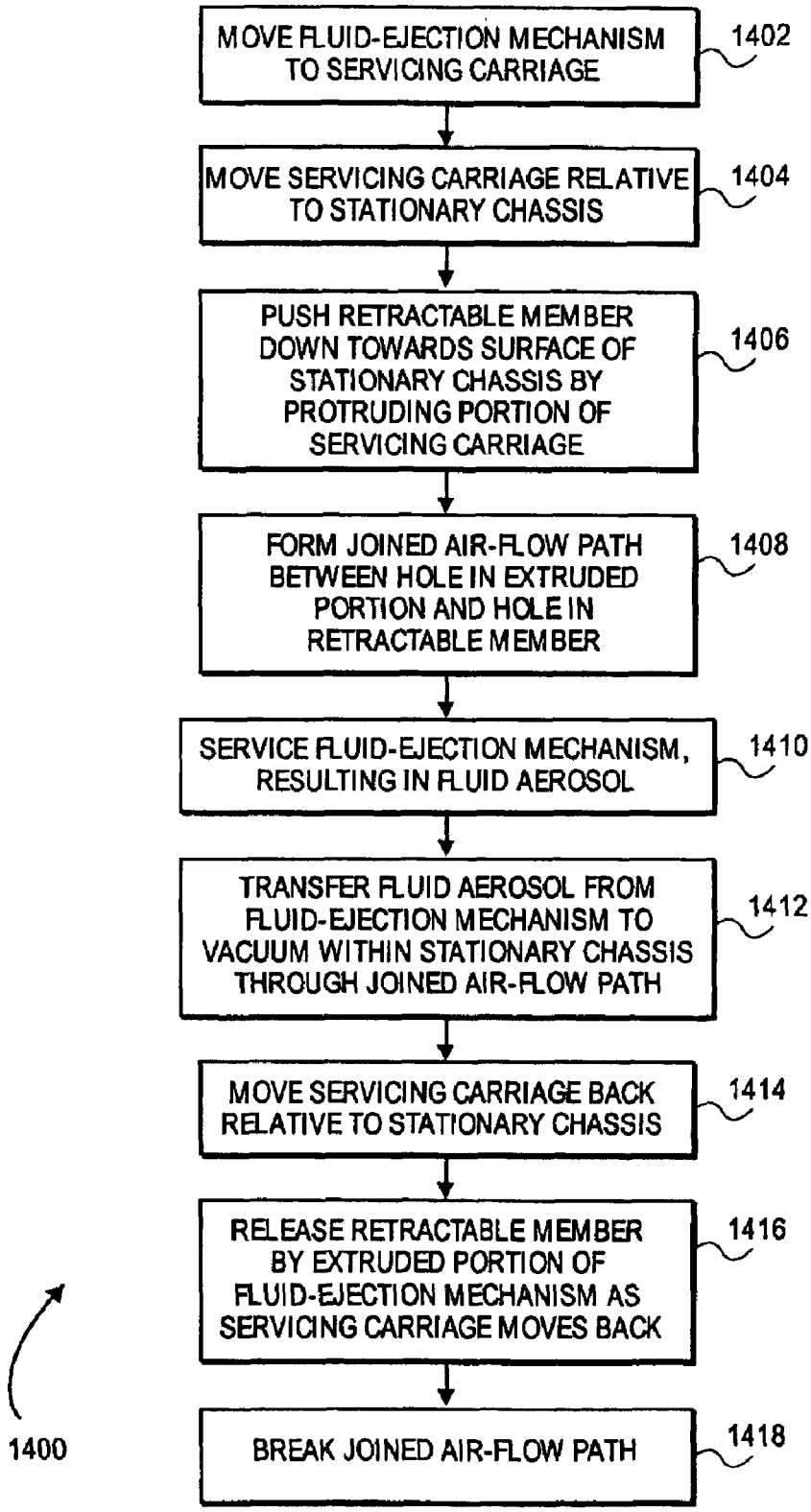
FIG. 14 is a flowchart of a method of use for a fluid-ejection device, according to an embodiment of the invention.

FIG. 14 shows a method 1400 of servicing a fluid-ejection device, according to an embodiment of the invention. As can be appreciated by those of ordinary skill within the art, the actions (i.e., the steps and/or acts) of the method 1400 may be performed as a result of being caused by an appropriately designed computer program. The computer program may thus have one or more computer program parts, such as subroutines, routines, objects, modules, portions, and so on, to cause the actions of the method 1400 to be performed. The program may be stored on a computer-readable medium, such as any of a number of different types of recordable data storage media.

The fluid-ejection device employed in the method 1400 may be the inkjet printer 100 of FIG. 1 that has been described. First a fluid-ejection mechanism is moved to a servicing carriage (1402). The fluid-ejection mechanism may be or include the inkjet print heads 114 of FIG. 5 that have been described, whereas the servicing carriage may be the servicing carriage 601 of FIG. 3 that has been described. The carriage has a surface from which a protruding portion thereof ends in a hole, defining an airflow path from the fluid-ejection mechanism.

The servicing carriage is moved relative to a stationary chassis (1404). The stationary chassis may be the stationary chassis 605 that has been described. The movement may be from the position of the movable chassis in FIGS. 6 and 12 to the position of the movable chassis in FIGS. 7 and 11, respectively. The chassis also has a hole through a surface thereof, which leads to a vacuum, and within which a retractable member is slidably and sealably inserted to define an airflow path to the vacuum. The retractable member may be the retractable element 602 of FIG. 6 or of FIG. 10 that has been described.

The movement of the servicing carriage relative to the stationary chassis results in the protruding portion of the servicing carriage pushing the retractable member down towards the surface of the stationary chassis (1406). A joined airflow path is thus formed between the hole in the protruding portion of the servicing carriage and the hole in the retractable member (1408). The joined airflow path extends from the fluid-ejection mechanism to the vacuum. The fluid-ejection mechanism can then be serviced, such as by performing a spitting process, which results in aerosol being released by the fluid-ejection mechanism (1410). As a result of the joined airflow path from the fluid-ejection mechanism to the vacuum within the stationary chassis, the aerosol is transferred from the fluid-ejection mechanism to the vacuum (1412).

The servicing carriage may then be moved back relative to the stationary chassis (1414). For instance, the movement may be from the servicing carriage's position depicted in FIGS. 7 and 11 to its position depicted in FIGS. 6 and 12, respectively. This movement back by the carriage relative to the chassis releases the extractable member from being contacted and pushed down by the protruding portion of the surface of the servicing carriage (1416). The joined airflow path that had been created is thus broken (1418), and the method 1400 can be finished.

CONCLUSION

It is noted that, although specific embodiments have been illustrated and described herein, it will be appreciated by those of ordinary skill in the art that any arrangement calculated to achieve the same purpose may be substituted for the specific embodiments shown. For instance, whereas embodiments of the invention have been described in particular relation to a wide- or large-format inkjet printer, other embodiments of the invention are applicable to other types of inkjet-printing devices, and more generally to other types of fluid-ejection devices. As a further example, the aerosol referred to herein may be fluid aerosol, such as ink aerosol, as well as other types of aerosol.

In addition, the cam-operated switching mechanism that has been shown and described is present in an exemplary embodiment of the invention, and not in all embodiments of the invention. In other embodiments, other types of switching mechanisms can be used. For instance, such switching mechanisms may include manual mechanical switches, automatic mechanical switches, electro-mechanical switches (e.g., relays), optical switches, as well as other types of switches. Furthermore, in some embodiments of the invention, the fan, vacuum, and other relatively noisy and bulky aerosol extraction equipment may be located in a static part of the printer, instead of in a moving part of the printer. As such, this noisy equipment can be properly sound insulated to quiet the aerosol extraction process as much as possible. In addition, location of the aerosol extraction equipment away from the moving part of the printer can result in its being more easily serviced.

Embodiments of the invention provide for advantages over the prior art. Extraction of aerosol results from both the print zone and the servicing zone. Only a single fan may be required for extraction of aerosol from both zones. The airflow that causes the aerosol extraction is thus efficiently used, resulting in less fan power and less fan cost as compared to prior art designs. The fan noise may therefore be reduced during printing, as compared to prior art designs, due to its smaller size and location in a sound-insulated area of the printer. Finally, extra parts or added complexity to add aerosol extraction from the servicing zone is not needed, since additional parts that may already be presented for aerosol extraction from the print zone can be leveraged.

Finally, it is noted that this application is intended to cover any adaptations or variations of embodiments of the present invention. Therefore, it is manifestly intended that this invention be limited only by the claims and equivalents thereof.

We claim:

1. A fluid-ejection device comprising:

a fluid-ejection mechanism capable of ejecting fluid onto media;

a scanning carriage on which the fluid-ejection mechanism moves while ejecting fluid onto the media; and, a service station to which the fluid-ejection mechanism is movable by the scanning carriage and at which fluid aerosol from the fluid-ejection mechanism is extracted by a vacuum via an airflow path from the fluid-ejection mechanism temporarily fluidically coupled to the vacuum during servicing of the fluid-ejection mechanism, wherein the service station comprises:

a stationary chassis having a hole through a surface thereof leading to the vacuum;

a retractable member slidably and sealably inserted within the hole of the surface of the stationary chassis, the retractable member defining the airflow path, the retractable member having a first position in which the retractable member is extended from the surface of the stationary chassis and a second position in which the retractable member is pushed downwards towards the surface of the stationary chassis; and, a movable service carriage receptive to the fluid-ejection mechanism as moved thereto by the scanning carriage, the movable service carriage movable over the stationary chassis and having a bottom surface from which a protruding portion thereof ends in a hole defining the airflow path, the protruding portion contactable with the retractable member to push the retractable member from the first position to the second position during servicing of the fluid-ejection mechanism.

2. The fluid-ejection device of claim 1, wherein the service station further comprises a spring mechanism cooperating with the retractable member to cause the retractable member to revert to and remain in the first position when the protruding portion no longer contacts and pushes the retractable member to the second position.

3. The fluid-ejection device of claim 1, wherein the fluid-ejection device is an inkjet-printing device and the fluid-ejection mechanism is an inkjet-printing mechanism having one or more inkjet printheads.

4. A fluid-aerosol extraction system for a fluid-ejection device comprising:

a retractable element having an airflow path therethrough and retractably mounted to a first part of the fluid-ejection device, the retractable element having a first position in which the retractable element is extended from the first part and a second position in which the retractable element is pushed downwards towards the first part; and, a ramped element having an airflow path therethrough and extending from a second part of the fluid-ejection device, the first part moving relative to the second part to cause the ramped element to contact the retractable element and push the retractable element from the first position to the second position, wherein the airflow path of the ramped element interacts with the airflow path of the retractable element in the second position to form a joined airflow path in which aerosol is transferable between the first and the second parts of the fluid-ejection device.

5. The system of claim 4, further comprising a spittoon into which a print head of the fluid-ejection device ejects fluid during servicing thereof, such that the aerosol results from ejection of the fluid during servicing of the fluid-ejection device.

6. The system of claim 5, wherein the airflow path of the ramped element begins at an opening at a top portion of the spittoon.

7. The system of claim 6, further comprising a cowl extending over the opening at the top portion of the spittoon, such that the airflow path is directed upwards relative to a direction of fluid ejection of the fluid ejected into the spittoon.

8. The system of claim 4, further comprising a vacuum-generating mechanism to create a vacuum to suck the aerosol through the joined airflow path.

9. The system of claim 8, wherein the vacuum-generating mechanism comprises a fan.

10. The system of claim 4, further comprising a duct extending from the vacuum to the joined airflow path.

11. The system of claim 4, further comprising a filter to collect the aerosol.

12. The system of claim 4, wherein the ramped element is a cam.

13. The system of claim 4, wherein the fluid-ejection device is an inkjet-printing device.

14. A service station for a fluid-ejection device having a fluid-ejection mechanism comprising:

a stationary chassis having a hole through a surface thereof leading to a vacuum;

a retractable member slidably and sealably inserted within the hole of the surface of the stationary chassis, the retractable member defining an airflow path to the vacuum, the retractable member having a first position in which the retractable member is extended from the surface of the stationary chassis and a second position in which the retractable member is pushed downwards towards the surface of the stationary chassis; and, a movable carriage receptive to the fluid-ejection mechanism and movable over the stationary chassis, the movable carriage having a bottom surface from which a protruding portion thereof ends in a hole defining an airflow path from the fluid-ejection mechanism, the protruding portion contactable with the retractable member to push the retractable member from the first position to the second position, wherein the airflow path of the protruding portion of the bottom surface of the movable carriage interacts with the airflow path of the retractable member in the second position of the retractable path to form a joined airflow path from the fluid-ejection mechanism to the vacuum to transfer fluid aerosol from the fluid-ejection mechanism to the vacuum.

15. The service station of claim 14, further comprising a spittoon into which the fluid-ejection device spits fluid during servicing thereof, the spittoon having an orifice located substantially at a top of the spittoon, the orifice operably coupled to a vacuum attracting the fluid aerosol.

16. The service station of claim 14, wherein the movable carriage moving over the stationary chassis such that the protruding portion of the bottom surface of the movable carriage no longer contacts and pushes the retractable member from the first position to the second position results in the retractable member reverting back to the first position, breaking the joined airflow path between the airflow path of the protruding portion and the airflow path of the retractable member.

17. The service station of claim 14, further comprising a spring mechanism cooperating with the retractable member to cause the retractable member to revert to and remain in the first position when the protruding portion no longer contacts and pushes the retractable member to the second position.

18. The service station of claim 14, wherein the fluid-ejection device is an inkjet-printing device.

19. A method comprising:

moving a fluid-ejection mechanism to a carriage, the carriage having a surface from which a protruding portion thereof ends in a hole defining an airflow path from the fluid-ejection mechanism;

moving the carriage relative to a stationary chassis having a hole through a surface thereof leading to a vacuum and within which a retractable member is slidably and sealably inserted to define an airflow path to the vacuum;

pushing the retractable member down towards the surface of the stationary chassis by the protruding portion of the surface of the carriage the carriage moves relative to the stationary chassis; and, forming a joined airflow path between the hole within an extended portion of a surface of the fluid-ejection mechanism and a tube, the joined airflow path extending from the fluid-ejection mechanism to the vacuum.

20. The method of claim 19, further comprising:

servicing the fluid-ejection mechanism, resulting in fluid aerosol; and, transferring the fluid aerosol from the fluid-ejection mechanism to the vacuum through the joined airflow path.

21. The method of claim 19, further comprising:

moving the carriage back relative to the stationary chassis;

releasing the retractable member by the protruding portion of the surface of the movable carriage as the carriage moves back relative to the stationary chassis; and, breaking the joined airflow path between the hole within the extended portion of the surface of the fluid-ejection mechanism and the tube.

22. A computer-readable medium having a computer program stored thereon adapted to implement the method of claim 19.

* * * * *